United States Patent [19]

Byer

[11] Patent Number: 4,699,093

[45] Date of Patent: Oct. 13, 1987

[54] LIGHT WEIGHT INTERNAL COMBUSTION ENGINE WITH STATIONARY PISTONS AND ROTARY VALVES

[76] Inventor: Joseph I. Byer, 2896 Radisson Ave., Windsor, Ontario, Canada, N9E 1Y3

[21] Appl. No.: 775,950

[22] Filed: Sep. 12, 1985

Related U.S. Application Data

[63] Continuation-in-part of Ser. No. 600,022, Apr. 13, 1987, abandoned.

[51] Int. Cl.[4] ..... F02B 59/00

[52] U.S. Cl. ..... 123/50 R; 123/41.34

[58] Field of Search ..... 123/50 R, 50 A, 41.35, 123/41.69, 42, 47 AB, 47 R, 80 R, 80 BA, 190 BA, 190 BB, 190 B, 63, 50 B, 671, 41.34

[56] References Cited

U.S. PATENT DOCUMENTS

| | | | |
|---|---|---|---|
| 746,212 | 12/1903 | Weatherholt | 123/50 A |
| 1,176,857 | 3/1916 | Samples | 123/80 BA |
| 1,223,701 | 4/1917 | Krienitz | 123/50 R |
| 1,238,024 | 8/1917 | Krienitz | 123/50 R |
| 1,545,205 | 7/1925 | Shaw | 123/80 BA |
| 1,812,862 | 7/1931 | Clarke | 123/50 A |
| 1,854,648 | 4/1932 | Foss | 123/190 BB |
| 2,241,910 | 5/1941 | Hull | 123/50 R |
| 2,834,329 | 5/1958 | Bachle et al. | 123/41.35 |
| 4,178,885 | 12/1979 | Konther et al. | 123/50 B |
| 4,182,283 | 1/1980 | Czuba | 123/50 R |

*Primary Examiner*—Craig R. Feinberg
*Assistant Examiner*—David A. Okonsky

[57] ABSTRACT

The engine of this invention comprises at least one hollow cylindrical member within which is a non-moveable disc that separates the cylinder into two opposite bores. A stationary piston is slideably contained in each bore. Each bore-piston combination contains an ignition means, a fuel passage and an exhaust passage. A valve connects with each of the passages and is timed to open and close to provide fuel, compression, and exhaust in conjunction with the ignition means to cause the cylindrical member to move in a reciprical motion with respect to the stationary pistons.

21 Claims, 12 Drawing Figures

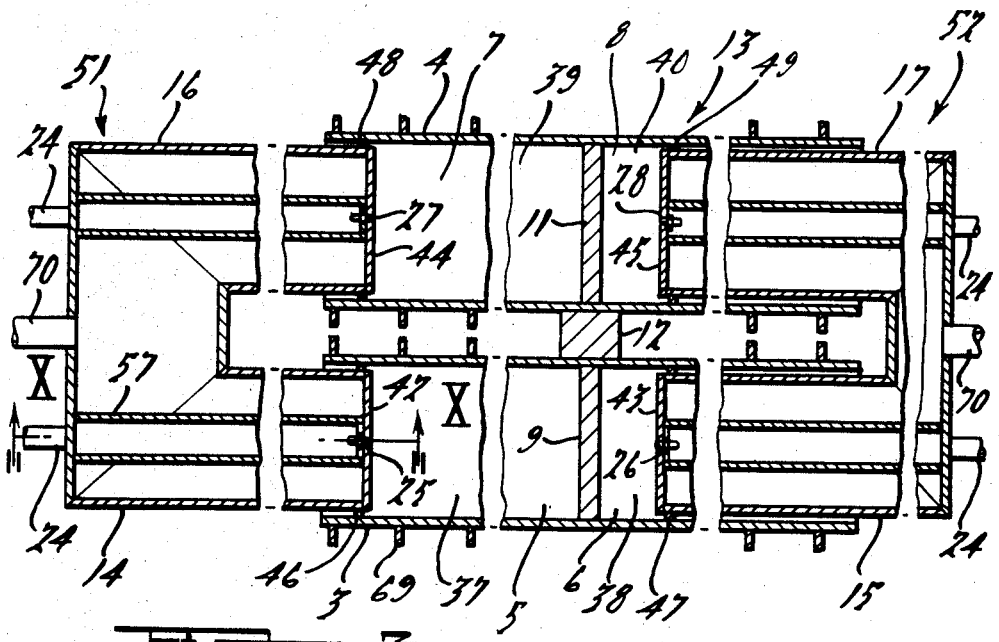
FIG. 3.
FIG. 4.
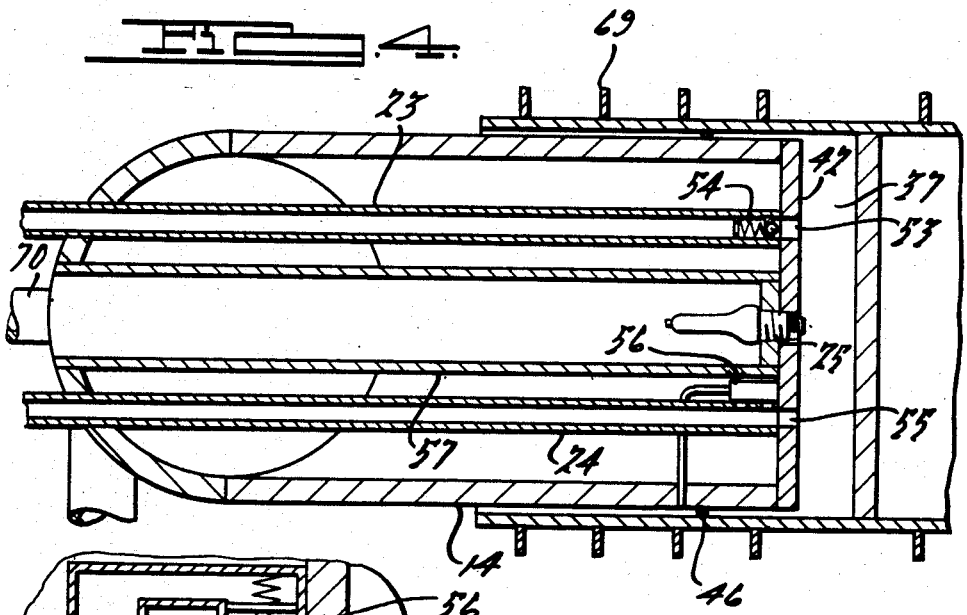
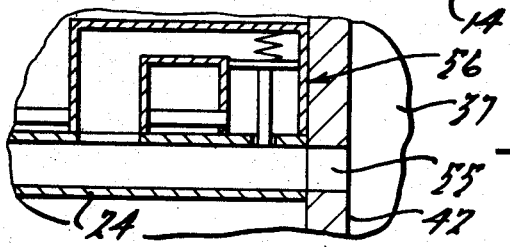
FIG. 4a.

LIGHT WEIGHT INTERNAL COMBUSTION ENGINE WITH STATIONARY PISTONS AND ROTARY VALVES

This application is a continuation-in-part, of application Ser. No. 600,022, filed 04/13/84 now abandoned.

The present invention relates to an engine design which eliminates the massive block of an internal combustion engine and most of the moving parts.

The invention provides an engine with fixed pistons, moveable cylinders and rotary valves which result in a significant reduction in the bulk of the engine and the number of moving parts. Power output from the engine is equivalent to that of conventional internal combustion engines. Since the mass of the engine is much less than a comparable internal combustion engine the power output to weight ratio is significantly higher which results in an improved overall efficiency.

Maintainance and manufacturing costs of the engine are substantially lower than a conventional internal combustion engine due to the small number of moving parts and the reduction of mass.

The invention relates to an engine which has pairs of opposed pistons rigidly fixed to a frame. Each pair of opposed pistons are slidably contained in two bores defined by a single moveable hollow cylinder, which has a solid partition. The fuel mixture is fed into, and the exhaust removed, from the bores by passages and a rotary valve means operating in a timed relation with an igniter means in the bores. Ignition of the fuel mixture causes the cylinder to move in a reciprocal motion with respect to the stationery pistons. The resultant reciprocal motion may be changed into rotary motion by a linkage means fastened to the cylinder and coupled to a "reciprocating to rotational motion converter" (RRMC). Cooling and lubrication means are embodied in the engine.

By way of example, specific embodiments of the invention will be described with reference to the accompanying drawings.

In drawings which illustrate embodiments of the invention,

FIG. 1 is a partial front view of the engine of this invention depicting two pairs of pistons, FIG. 2 is a plan view of the engine of FIG. 1, FIG. 3 is a cross-sectional view along the line II—II of FIG. 1, FIG. 4 is a cross-sectional view along the line X—X of FIG. 3, FIG. 4 (a) is an enlargement of the exhaust valve assembly shown in FIG. 4, FIG. 5 is a cross-sectional view through one rotary valve along V—V of FIG. 2, and FIG. 6 (*a*) through FIG. 6 (*d*) are diagramatic views of the operational position of one rotary valve for a two-cylinder engine. The letters on all of these figures have the following meaning:

I=INTAKE

E=EXHAUST

P=POWER

K=COMPRESSION

EFMS means external fuel mixture supply.

Figure 1:
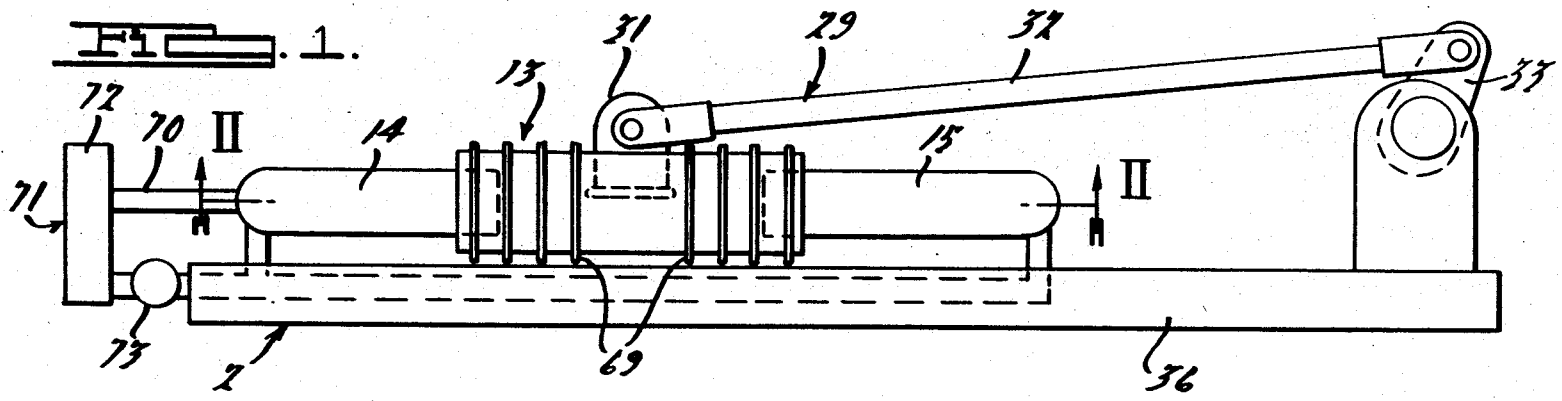
Figure 2:
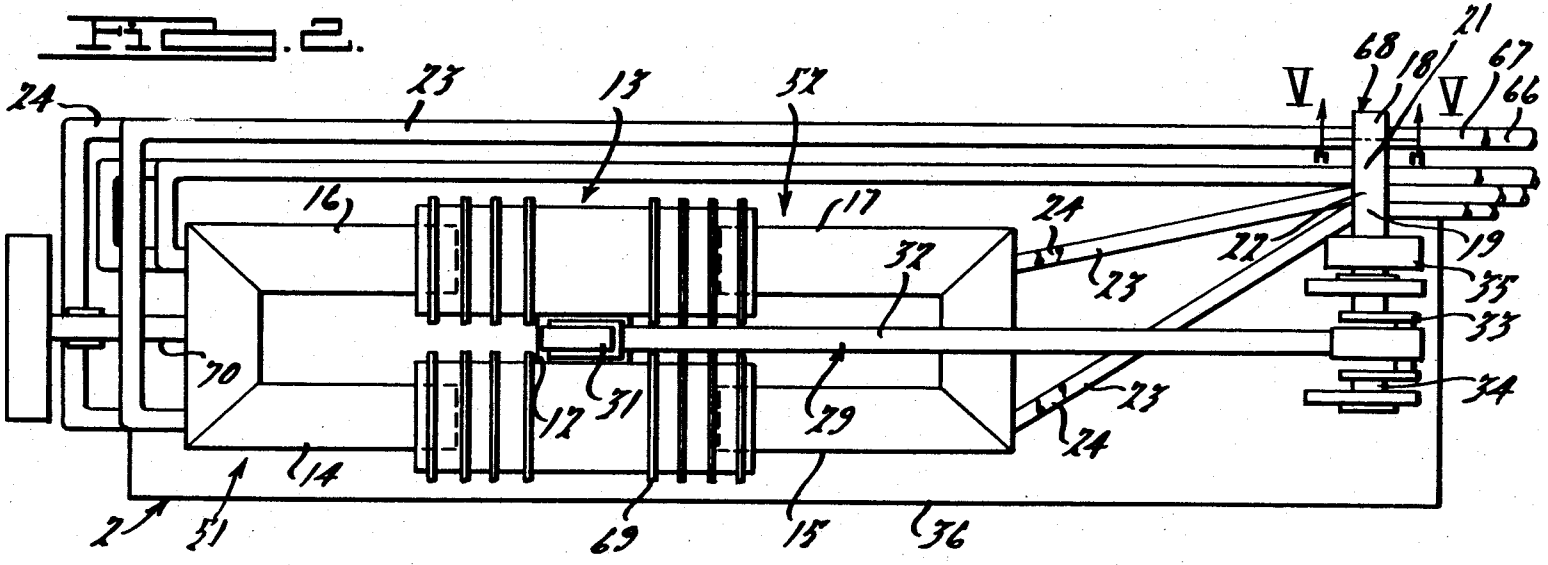

This invention relates to an internal combustion engine 2, as shown, in general, in FIG. 1 and FIG. 2. The engine 2 comprises a pair of moveable, hollow cylinders 3 and 4, best seen in FIG. 3, each divided into two bores 5, 6 and 7, 8 by partitions 9, 11, connected in a parallel relationship by a rigid union 12 to form cylinder assembly 13, two pairs of opposite extending stationery, hollow pistons, 14, 15 and 16, 17, a set of four valve means such as rotary valves 18, 19, 21, 22, shown in FIG. 2 and described in greater detail later, which regulate the operational state of each piston, a fuel mixture passage 23 and an exhaust passage 24 for each piston, as best seen in FIG. 4, an igniter means 25, 26, 27, 28 in each piston, as shown in FIG. 3 and as seen in FIGS. 1 and 2, a power take off means 29 comprising of a connecting rod mount 31, a connecting rod 32, a crankshaft throw 33 and a crankshaft 34, a connecting means such as a speed reducer 35 connected to the crankshaft 34 and rotary valves 18, 19, 21, 22. The speed reducer 35 positions the rotary valves 18, 19, 21, 22 and sets an electrical switching device well known in the art to activate an igniter means such as a conventional spark plug 25, 26, 27, 28, as seen in FIG. 3, in a timed relationship to cause a fuel mixture to explode, thereby moving cylinder assembly 13 in reciprocating motion. A rigid frame 36, as seen in FIG. 1 and FIG. 2, supports and connects the various engine components.

In an embodiment of this invention, as best seen in FIG. 3, one hollow cylinder member 3 is divided into two bores 5, 6 by a solid circular disc 9, the second hollow cylinder member 4 is divided into two bores 7, 8 by a partition disc 11. Each bore 5, 6, 7, 8 is a part of a combustion chamber 37, 38, 39, 40, respectively. Combustion chamber 37 is oppositely positioned to a second combustion chamber 38 and a third combustion chamber 39 is oppositely positioned to a fourth combustion chamber 40. One typical combustion chamber 37, as seen in FIG. 3, is defined by a piston face 42 of the piston 14, a piston ring 46 which is attached to the external peripheral surface of piston 14, the bore 5 of cylinder 3, and partitions 9. The other pistons 15, 16, 17 likewise have piston rings 47, 48, 49. The two cylinders 3, 4 are connected in a parallel relationship by the coupling means 12 as seen in FIG. 2, in order to form cylinder assembly 13. The connecting rod mount 31 is fastened to the rigid union 12 to hold one end of the connecting rod 32. It is to be understood that lubrication, as known in the art, has to be provided between the surfaces of the moving cylinder assembly 13 and the piston rings 46, 47, 48, 49. Pistons 14 and 16 are the legs of a hollow, tubular member 51 formed in the shape of a "U", as best seen in FIGS. 2 and 3 and pistons 15 and 17 are legs of another tubular member 52 oppositely disposed to the first tubular member 51. The ends of the tubular members 51, 52 are closed with circular discs which form piston faces 42, 43, 44, 45, as best seen in FIGS. 3 and 4.

The construction of one typical piston of this invention, for example piston 14, can be best followed when refering to FIG. 4. The fuel mixture passage 23 which originates at rotary valve 18, as seen in FIG. 2, extends longitudinally through the piston 14, as seen in FIG. 4, to an aperature 53 in piston face 42. A fuel valve assembly 54, such as a ball valve, as is well known in the art, is located in the fuel mixture passage 23 at the entrance to the combustion chamber 37. The exhaust passage 24 also originates at rotary valve 18 in a spaced relationship below the fuel mixture passage 23 and extends longitudinally through the piston 14 to a second aperature 55 in piston face 42. An exhaust valve assembly 56 such as a gate valve, as is well known in the art, is located in the exhaust passage 24 at the entrance to combustion chamber 37. The spark plug 25 extends from the inside of piston 14 through the piston face 42 so that its conventional electrodes are just inside the combustion chamber 37. A fuel igniter egress tube 57 originates at the back of the piston 14 and terminates on the piston face 42 surrounding igniter means 25. The fuel valve assembly 54, as seen in FIG. 4, closes when the combustion chamber 37 is under compression and opens only when rotary valve 18 is in the intake position, as seen in FIG. 6 (*a*). The exhaust valve assembly 56, as seen in FIG. 4, opens for exhausting the spent fuel mixture only when the rotary valve 18 is in the exhaust position, as seen in FIG. 6 (*d*). Both valve assemblies 54 and 56 work in conjunction with the rotary valves 18, 19, 21, 22 to provide valve action at the combustion chamber 37, 38, 39, 40. The fuel igniter egress tube 57 provides access for the removal or installation of the fuel igniter 25.

Figure 5:
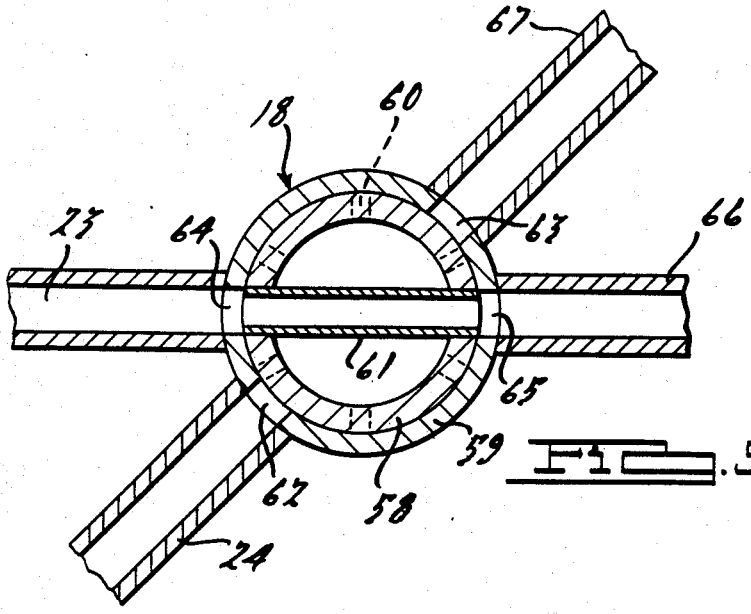
Figure 6A:
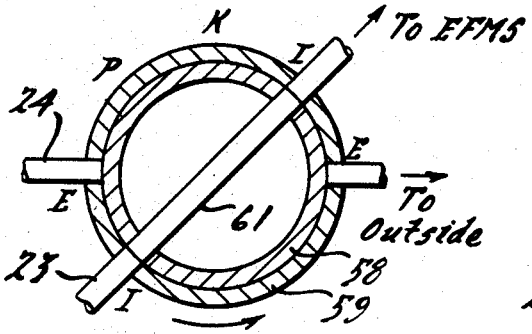
Figure 6C:
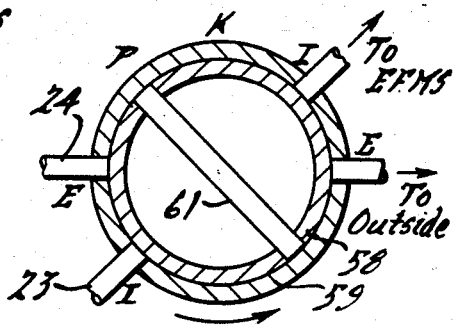
Figure 6B:
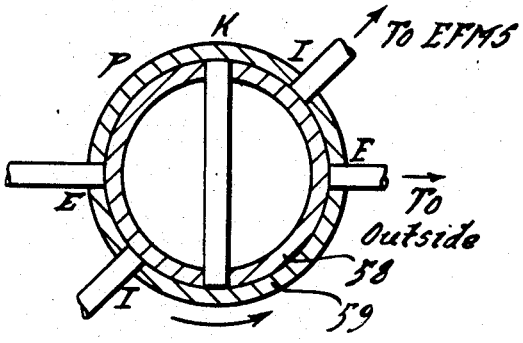
Figure 6D:
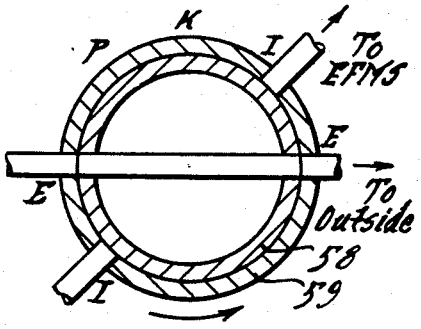

A rotary valve unit 68, as seen in FIG. 2, comprising the four rotary valves 18, 19, 21, 22 is connected to the speed reducer 35. These rotary valves provide the fuel mixture intake and exhaust for the combustion chamber they are connected to. A cross-section V—V through the rotary valve unit 18 is shown in FIG. 5. The rotary valve unit 68 is comprised of a hollow rotatable cylinder member 58, slideably contained in a hollow, fixed cylinder member 59. At each location of the rotary valves 18, 19, 21, 22 a hollow conduit tube 61 passes laterally through a diameter of the rotatable cylinder member 58. The four hollow conduit tubes 61 rotate with the rotatable cylinder member 58. Each of these hollow conduit tubes is a rotary valve, since in the proper spatial position they form a passageway for either the fuel mixture or the spent fuel mixture.

The rotary valve 18 is typical of all the rotary valves. As seen in FIG. 5 there are a first pair of aperatures 64 and 65 in the fixed cylinder member 59 which are oppositely positioned and aligned such that when the hollow conduit tube 61 is rotated into the horizontal position a passageway through the fixed cylinder member 59 is established. The first fuel mixture passage 23 is connected at one end to the fixed cylinder member 59 around the aperature 64 and at the other end to the combustion chamber 37 around aperature 53, best seen in FIG. 4, the second fuel mixture passage 66 originates at the fixed cylinder member 59 around the aperature 65 and terminates at the external fuel mixture supply. The passageway through the fixed cylinder member along with the fuel mixture passages 23 and 66 forms a complete passage from the external fuel mixture supply to the combustion chamber 37. A second pair of aperatures 62 and 63 in the fixed cylinder member 59 are oppositely positioned and aligned to form a passageway through the fixed cylinder member 59 when the conduit tube 61 is at a 45 degree angle to a line joining the centres of aperature 62 and aperature 63.

The first exhaust passage 24, starts at the fixed cylinder member 59 around the aperature 62 and terminates at the combustion chamber 37 around the aperature 55, best seen in FIG. 4, the second exhaust passage 67 originates at the fixed cylinder member around aperature 63 and extends to a position to discharge the spent fuel mixture to the atmosphere. When the hollow conduit tube 61 connects aperatures 62 and 63 a passage from combustion chamber 37 into the atmosphere is established. As seen in FIG. 5, when the hollow conduit tube 61 connects to the two fuel mixture passages 23 and 66, the two exhaust passages 24 and 67 are sealed by the rotatable cylinder member 58, and when it connects the two exhaust passages 24 and 67, the two fuel mixture passages are closed by the rotatable cylinder member 58. The four conduit tubes 61 of the rotary valves 18, 19, 21, 22 are so positioned as to provide the proper sequence of power, exhaust, compression and intake for each of the four combustion chambers 37, 38, 39, 40. The rotatable cylinder member 58 which is sealed at each end is filled with oil, by a means well known in the art, which seeps through holes 60 drilled in its walls, seen in FIG. 5, to provide lubrication for the moving surfaces. Reciprocal motion of the cylinder assembly 13 of the engine 2, as best seen in FIG. 1 and FIG. 2, is converted into rotational motion by the power take off means 29.

As seen in FIG. 1 and FIG. 2 rotation of the crankshaft 34 rotates the speed reducer 35 which rotates the rotatable cylinder 59 of the rotary valve unit 68 causing all the rotary valves 18, 19, 21, 22 to rotate simultaneously.

The crankshaft rotation operates an ignition timing device, as known in the art, to activate the fuel igniter means 25, 26, 27, 28 to achieve ignition in the proper time relation.

The operation of the engine 2 can best be seen by referring to FIG. 3 and FIGS. 6 (*a*), 6 (*b*), 6 (*c*), 6 (*d*). The moveable cylinder assembly 13 is moved into the position shown in FIG. 3 by an external starting means, as known in the art, which sets the engine 2 in start position. The combustion chamber 40 of piston 17 contains fuel mixture under compression, its rotary valve 22 is in the power position as seen in FIG. 6 (*c*), and combustion chamber 39 of piston 16 contains spent fuel mixture, its rotary valve 21 is in the beginning of the exhaust position, as seen in FIG. 6 (*d*). At the same time combustion chamber 37 of piston 14 contains fuel mixture at atmospheric pressure, its rotary valve 18 is in the fuel mixture compression position, as seen in FIG. 6 (*b*), and the combustion chamber 38 of piston 15 contains the remnance of the spent fuel mixture at atmospheric pressure, its rotary valve 19 is in the beginning of the fuel intake position, as seen in FIG. 6 (*a*). A timing device, as known in the art, activates only igniter means 28. An explosion, brought about by the ignition of the fuel mixture by the fuel igniter means 28 in the combustion chamber 40 of piston 17 forces the cylinder assembly 13 to move to the left, as seen in FIG. 3, so that a crankshaft 34, best seen in FIG. 2 is rotated by a connecting rod 32 and crankshaft throw 33 causing the rotatable cylinder member 58 of the rotary valve unit 68 to be rotated by speed reducer 35. When the leftmost position of the cylinder assembly 13 is reached, the rotatable cylinder member 58 of the rotary valve unit 68 is turned so that rotary valve 18 is in the power position, as seen in FIG. 6 (*c*), rotary valve 19 is in the compression position, as seen in FIG. 6 (*b*), rotary valve 21 is in the intake position, as in FIG. 6 (*a*), and rotary valve 22 is in the exhaust position as in FIG. 6 (*d*).

During the movement of the cylinder assembly 13 to the left the rotatable cylindrical member 58 was turning, the fuel mixture in combustion chamber 37 of piston 14 was compressed and also fuel mixture was introduced into combustion chamber 38 of piston 15, concurrently the spent fuel was exhausted from combustion chamber 39 of piston 16 and the fuel mixture in combustion chamber 40 of piston 17 was combusted. The timing device now activates only igniter means 25 causing an explosion in combustion chamber 37 of piston 14 by ignition of the fuel mixture which moves cylinder assembly 13 to the right. When the extreme right position of cylinder assembly 13 has been reached, the rotatable cylinder member 58 of the rotary valve unit 68 has been revolved to the position where rotary valve 18 is in the exhaust position, as in FIG. 6 (*d*), rotary valve 19 is in the power position, as in FIG. 6 (*c*), rotary valve 21 is in the compression position, as in FIG. 6 (*b*), and rotary valve 22 is in the intake position, as in FIG. 6 (*a*). As the cylinder assembly 13 moved to the right and the rotatable cylindrical member 58 was turning, the fuel mixture in combustion chamber 37 of piston 14 has been combusted, concurrently the fuel mixture in combustion chamber 38 of piston 15 was compressed, fuel mixture was taken into combustion chamber 39 of piston 16, and the spent fuel mixture has been exhausted from combustion chamber 40 of piston 17. The timing device is now positioned to activate igniter means 26 causing an explosion in combustion chamber 38 of piston 15 by the ignition of the fuel mixture which moves cylinder assembly 13 to the left. When the cylinder assembly 13 reaches its extreme left position the rotatable cylinder member 58 of the rotary valve unit 68 is positioned so that rotary valve 18 is in the intake position, as in FIG. 6 (*a*), rotary valve 19 is in the exhaust position, as in FIG. 6 (*d*), rotary valve 21 is in the power position, FIG. 6 (*c*), and rotary valve 22 is in the compression position. While the cylinder assembly 13 moved to the left the spent fuel was exhausted from combustion chamber 37 of piston 14, the fuel mixture was combusted in combustion chamber 38 of piston 15, the fuel mixture in combustion chamber 39 of piston 16 was compressed and fuel mixture was introduced into combustion chamber 40 of piston 17. The timing device now is so positioned to activate only fuel igniter 27 which ignites the fuel mixture in combustion chamber 39 of piston 16 causing an explosion that moves cylinder assembly 13 to the right. When the cylinder assembly 13 reaches its right most position the rotatable cylinder member 58 of the rotary valve unit 68 is rotated to a position where rotary valve 18 is in the compression position, as in FIG. 6 (*b*), rotary valve 19 is in the intake position, as in FIG. 6 (*a*), rotary valve 21 is in the exhaust position, as in FIG. 6 (*d*), and rotary valve 22 is in the power position, as in FIG. 6 (*c*). As the cylinder assembly 13 moved to the right, fuel mixture was introduced into combustion chamber 37 of piston 14, the spent fuel mixture was exhausted from combustion chamber 38 of piston 15, the fuel mixture was combusted in combustion chamber 39 of piston 16 and the fuel mixture was compressed in combustion chamber 40 of piston 17. Each of the four combustion chambers 37, 38, 39, 40, valves 18, 19, 21, 22 of the pistons 14, 15, 16, 17 are now in the original starting state thus completing a single cycle. The process is repeated until either no fuel mixture is added or no ignition is provided. There are two rotations of the crankshaft 34, one rotation of each rotary valve 18, 19, 21, 22 and one rotation of the ignition timer for each complete cycle. Speed reducer 35 connects the crank-shaft 34 with the rotary valve unit 68 and the ignition timer, and reduces their rotational speed to one half that of the crankshaft 34.

The moving cylinders 3 and 4 are provided with fins 69, as best seen in FIG. 3, and are air cooled. Cooling of pistons 14, 15, 16, 17 is accomplished by a cooling system 71, well known in the art, comprising a conventional radiator 72 and pump 73, shown in FIG. 1.

Figure 7:
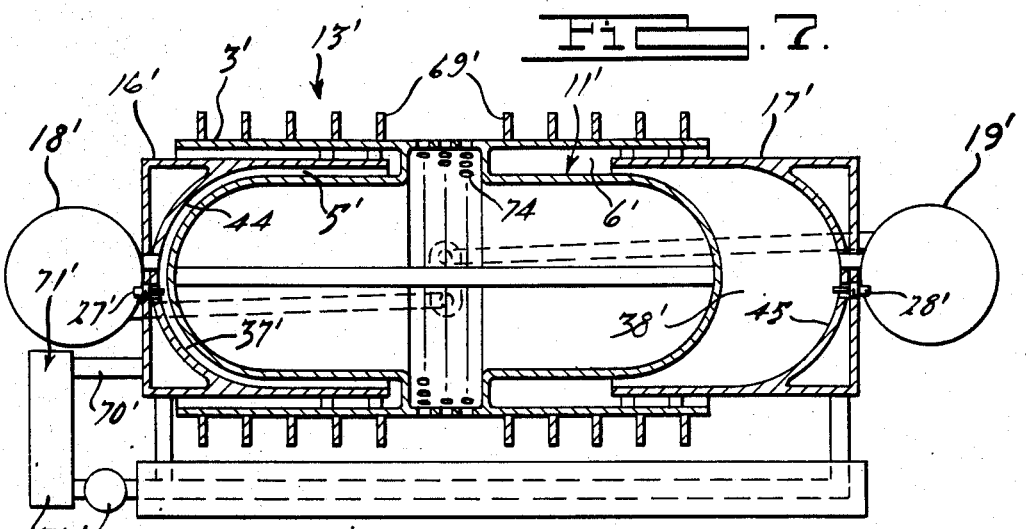
FIG. 7 is a partial front view of a preferred embodiment of the engine of this invention depicting two pairs of pistons with paraboloaid-like faces and a matching partition.
Figure 8:
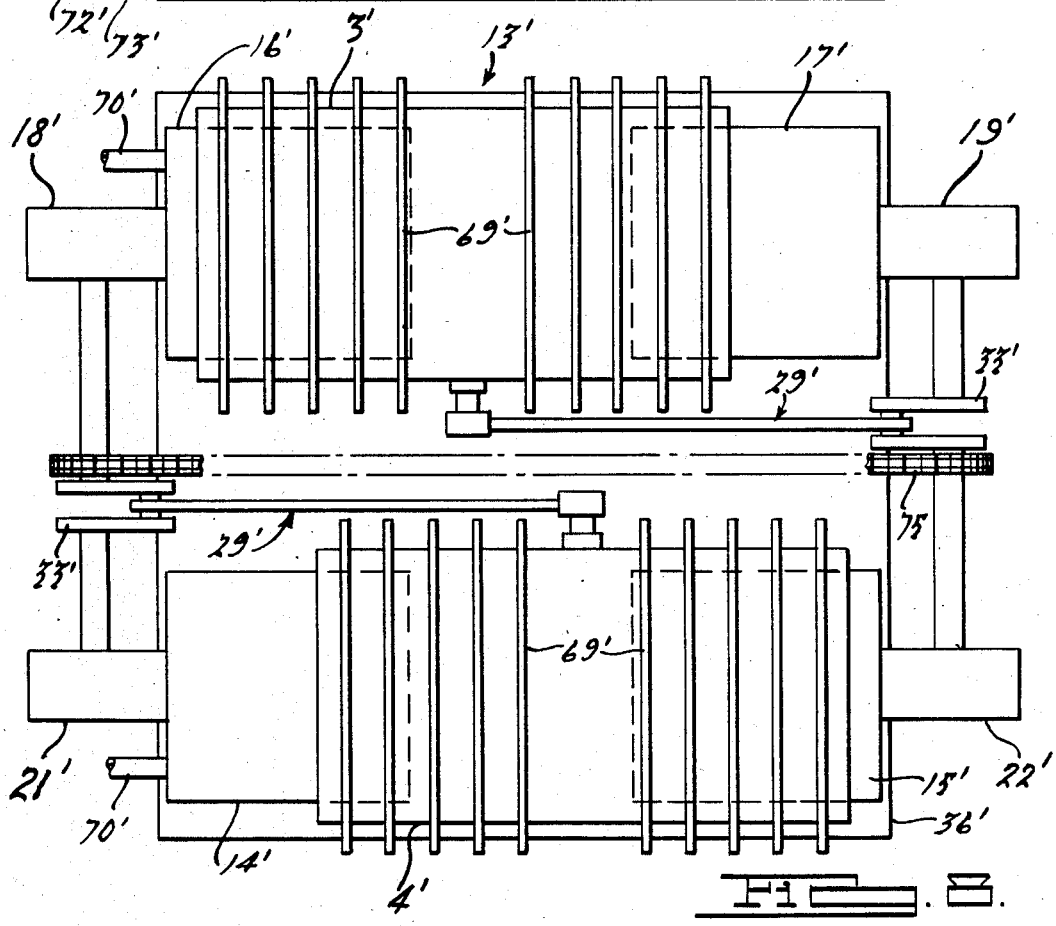
FIG. 8 is a plan view of the engine of FIG. 7.

As can be understood from the description of the operation of the engine 2, it is light weight since most of the component parts are hollow; it has a minimum number of moving parts and is of simple compact construction. The engine therefore has a large power to weight ratio which gives greater efficiency; is durable requiring minimum maintenance and is inexpensive to manufacture. Because of the compactness and light weight of the engine, other engines may be introduced within the same space and weight limitations of a conventional engine to utilize the heat normally rejected through the cooling system and exhaust, thereby increasing the efficiency still further. It is to be understood that the engine of this invention can be expanded to a two-cycle or multi-cycle operation as well as being combined as multiple units (modules) for special application requiring increased power output and the engine could be comprised of a single cylinder, with two cycle operations well known in the art, or three or more cylinders. It is to be further understood that the engine of this invention could be made with pistons, as shown in FIG. 7, having inward paraboloid faces 44 and a cyllinder partition 11' of two oppositely extending hollow paraboloids joined by a rod fastened to their vertices as well as other configurations. In this form the rotary valve 18' is adjacent to the combustion chamber 37' thereby eliminating long exhaust and fuel passageways of FIG. 4 and the spark plug is inserted directly from the back of the piston to the combustion chamber so eliminating the spark plug egress tube 57 in FIG. 4. FIG. 8 depicts the engine where two parallel cylinders move in opposite directions by using two crankshafts 29' which are connected by a sprocket-chain assembly 75. The crankshafts 29' comvined with chaim assembly 75, best seen in FIG. 8, move cylinders 3' 4' in opposite directions. In FIG. 8 combustion chamber of piston 16' is in the power mode, combustion chamber of piston 17' is in the compression mode, combustion chamber of piston 15' is in the intake mode and combustion chamber of piston 14' is in the exhaust mode when the fuel in combustion chamber 37' (FIG. 7) is ignitied cylinder 4 moves to the right and cylinder 3' moves to the left. The combustion chamber of piston 17' is compressed, that of 14' is exhausted and that of 15' in intake. Through a timed relationship between the rotary valves 18', 19', 21' and 22' with cylinders 4' and 3' and the four ignition means the fuel in the combustion chamber of piston 49' is ignited and cylinder 4' moves to the left while cylinder 3 moves to the right. The process continues through four cycle operation well known in the art and the cylinders reciprocate in opposite directions until fuel or ingition is cut off.

It will be understood that this invention is not to be limited to the exact construction shown and described, but that various modifications and changes may be made without departing from the spirit and scope of the invention as defined in the appended claims.

The embodiments of the invention in which an exclusive property or privilege is claimed are defined as follows:

1. An internal combustion engine comprising a pair of stationary pistons with closed inner end surfaces which extend toward and in spaced relation to each other being hemispherical and forming an outer boundary for respective combustion chambers, valve means connected to passage means, said passage means connected to each of said closed inner end surfaces, a single movable cylindrical member sealingly positioned between said pistons and arranged to reciprocate back and forth relatively to and upon said pistong back and forth relatively to and upon said pistons thereby forming an inner boundary for said respective combustion chambers, said cylinderical member having opposed end surfaces which form said inner boundaries wherein said opposed end surfaces of said cylindrical member are spaced from one another such that a hollow internal volume is formed, said internal volume between said opposed end surfaces is open to cooling air through openings in a mid-region of said cylindrical member.

2. The engine, according to claim 1 pistons are hollowed to allow for the circulation of coolant, which in which said within said pistons.

3. The engine, according to claim 1, includes a heat exhange system to circulate coolant within said pistons.

4. The engine of claim 1 wherein the valve means comprises sections, one for each said piston, each section being a rotary valve which provides fuel mixture and exhaust for said combustion chamber, the rotary valves arranged to operate in a timed relation.

5. The engine, according to claim 1, in which igniter means ignites fuel air mixture in a timed relation to cause said cylindrical members to move in reciprocal motion in relation to the said fixed pistons.

6. The engine, according to claim 1, having a reciprocal motion to rotational motion converter (RRMC) to obtain rotational motion output.

7. An engine according to claim 1 in which said cylindrical member is provided with external cooling fins.

8. An engine, according to claim 1, comprising multiple cylindrical members in parallel relationship, a pair of stationery pistons for each of said cylindrical members, ignition means extending into said combustion chambers, passage and valve means, said passage means connected to each of said pistons, said passage means comprising a fuel mixture passage for providing fuel mixture into said combustion chambers and an exhaust passage for removing spent fuel mixture, said valve means operable to be placed in an open and closed poisiton in a timed relationship to allow the fuel mixture to be ignited by said igniter means in said combustion chambers and to provide a connection for said exhaust passage through said pistons to said combustion chambers to cause said cylindrical members to move in a reciprocal motion with respect to the stationary pistons.

9. The engine, according to claim 8, in which said igniter means ignites said fuel air mixture in a timed relation to cause said multiple cylindrical members to move in a reciprocal motion in relation to said fixed pistons.

10. The engine as of claim 1 including a power take off means and linkage means.

11. The engine of claim 10 in which said linkage means comprises a mount fastened to said cylindrical member coupled to said reciprocating to rotational motion/converter (RRMC).

12. The engine according to claim 1 combined with a similar engine that is modfied to operate as an external combustion engine.

13. The engine according to claim 1 wherein the passage and valve means is integrally mounted with said pistons, said passage and valve means comprising a valve mechanism when in an open position in relation to a fuel mixture passage allows the fuel mixture to enter one of the said combustion chambers through said fuel mixture passage while keeping an exhaust passage closed.

14. The engine according to claim 13 in which the passage and valve means in which said mechanism when in an open position in relation to said exhaust passage in one of said combustion chambers allows the exhaust of that combustion chamber through said exhaust passage while keeping said fuel passage closed.

15. The engine according to claim 13 wherein the valve means includes a fuel valve assembly located in the said fuel mixture passage at the entrance to said bore, said fuel valve assembly being in an open position in relation to said fuel mixture passage to allow for providing fuel mixture into said bores.

16. The engine according to claim 13 in which the valve means includes an exhaust valve assembly, located in the said exhaust passage at the entrance to said bore, said exhaust valve assembly being in an open position in relation to said exhaust passage to allow for providing exhaust of the fuel mixture.

17. The engine according to claim 13 wherein the valve mechanism comprises a moveable member having a passageway, said member moveable from a first position connecting said passageway with the said fuel mixture passage, to a second position connecting said passageway with said exhaust passage.

18. The engine according to claim 17 in which the moveable member comprises a rotatable cylinder and a connecting means, said connecting means linking said rotatable cylinder to said cylindrical member, the reciprocal motion of said cylindrical member rotating said rotatable cylinder.

19. The engine according to claim 18 in which the rotatable cylinder containing said passageway, said passageway in one position connecting said fuel mixture passage to said bore keeping said exhaust passage closed and in a second position connecting said exhaust passage to said bore keeping said fuel mixture passage closed.

20. An internal combustion engine comprising a pair of stationary pistons with closed inner end surfaces which extend toward and in spaced relation to each other being parabaloidal and forming an outer boundary for respective combustion chambers, valve means connected to passage means, said passage means connected to each of said closed inner end surfaces, a single movable cylindrical member sealingly positioned between said pistons and arranged to reciprocate back and forth relatively to and upon said pistons thereby forming an inner boundary for said respective combustion chambers, said cylindrical member having opposed end surfaces which form said inner boundaries wherein said opposed end surfaces of said cylindrical member are spaced from one another such that a hollow internal volume is formed, said internal volume between said opposed end surfaces is open to cooling air through openings in a mid-region of said cylindrical member.

21. The engine, according to claim 20, in which igniter means ignites fuel air mixture in a timed relation to cause said pair of cylindrical members to move in a reciprocal motion in relation to said fixed pistons.

* * * * *